United States Patent [19]

Magni et al.

[11] Patent Number: 4,668,241

[45] Date of Patent: May 26, 1987

[54] METHOD OF DYEING POLYCAPRONAMIDE TEXTILE ARTICLES USING TWO ACID DYE COMBINATIONS WITH DIFFERENT DYEING KINETICS

[75] Inventors: Eugenio Magni, Busto Arsitzio; Claudio Pernetti, Milan, both of Italy

[73] Assignees: Snia Fibre S.p.A., Cesano Maderno; Snia Viscosa S.p.A., Milano, both of Italy

[21] Appl. No.: 723,726

[22] Filed: Apr. 17, 1985

Related U.S. Application Data

[63] Continuation of Ser. No. 504,512, Jun. 15, 1983, abandoned.

[30] Foreign Application Priority Data

Jun. 15, 1982 [IT] Italy ..... 21857 A/82

[51] Int. Cl.[4] ..... D06P 3/24; D06P 1/39

[52] U.S. Cl. ..... 8/638; 8/680; 8/924; 8/400; 8/641; 8/929

[58] Field of Search ..... 8/638, 680, 641

[56] References Cited

U.S. PATENT DOCUMENTS

| | | | |
|---|---|---|---|
| 3,980,428 | 9/1976 | Fabbri et al. | 8/578 |
| 4,252,531 | 2/1981 | Daeuble et al. | 8/531 |
| 4,381,186 | 4/1983 | Magni et al. | 8/620 |
| 4,445,905 | 5/1984 | Schaetzer et al. | 8/641 |

*Primary Examiner*—A. Lionel Clingman

*Attorney, Agent, or Firm*—Wenderoth, Lind & Ponack

[57] ABSTRACT

A method of dyeing textile materials of polycapronamide, enabling low temperature dyeing conditions and process duration times which do not exceed the art standards, is characterized by the following combined features: (a) use of at least two discrete combinations of dyestuffs, which show different kinetic behaviors from each other; (b) maintenance of an alkaline pH at tapering values, in the extreme down to neutral; (c) use of exclusively anionic dyeing aids; and (d) maintenance through the various method steps of a maximum temperature as high as 60° C., preferably as 40° C.

Perfectly uniform dyeing is achieved through the utilization of conventional apparata and dyeing method procedures.

1 Claim, No Drawings

METHOD OF DYEING POLYCAPRONAMIDE TEXTILE ARTICLES USING TWO ACID DYE COMBINATIONS WITH DIFFERENT DYEING KINETICS

This application is a continuation, of now abondoned application Ser. No. 504,512, filed June 15, 1985, now abandoned.

BACKGROUND OF THE INVENTION

1. Field of the invention

This invention relates to an improved method of dyeing textile materials of polycapronamide or Nylon 6 (a polymer of caprolactame). More specifically, the invention concerns the dyeing of Nylon 6 short fiber or staple with acidic dyestuffs, in particular for dyeing carpets from such materials, and even more particularly for dyeing with a method known as "winch".

As a rule, polyamide staples of Nylon 6 have a fairly high dye pick-up rate, which can be ascertained through a standard test to be explained hereinafter. Should a particular Nylon 6 staple fail to provide satisfactory results when so tested, the results of an application of this invention to that particular staple may be disappointing, and apt to be in all cases below optimum. Therefore, the invention is concerned, in a particularly preferred way, with those Nylon 6 staples which meet the requirements of the test presently described, and to articles of manufacture—in particular carpets—formed from such staples.

The test in question is as follows.

5 g of the fiber to be tested are weighed and a dyeing step conducted in the following conditions:

the dyeing bath is prepared at 20° C. with: C.I. acid blue 280 as applied at the standard intensity of 1/1 (e.g., 2% Blue Nylosan N-5GL 200% —Sandoz)

pH=6 buffered (e.g., about 2.5 g/l monosodic phosphate and 0.5 g/l bisodic phosphate)

R.B.=1:60 with the use of soft water.

R.B. stands for Bath Ratio, i.e. the ratio of the amount in g of material to be dyed to the amount in cc of the dyeing bath (e.g., R.B.=1:60—5 g fiber and 300 cc dyeing bath);

the material to be dyed is introduced into the dyeing bath so prepared, stirred continuously, and held there for 10 minutes at 20° C., thereafter the dyeing bath is heated slowly and gradually for 40 minutes (heating thermal gradient of 1° C./min) to 60° C. and held there for 60 minutes at a constant temperature of 60° C.

Those fibers which respond satisfactorily are all those fibers which, when subjected to the test described above, provide almost complete exhaustion of the dyeing bath, that is at a final dye concentration in the spent dyeing bath not exceeding 10% of its initial concentration.

Throughout the description which follows, we will make specific reference to the dyeing of carpets with the cited winch method, without this being directed to restrict the invention scope but rather understood to illustrate a typical and particularly preferred embodiment thereof and the field of application where the invention is particularly useful.

2. Prior Art

Dyeing the materials in question has met, in the historical development of the art, with various difficulties. On the one side, dyeing faults are easily encountered, such as striping, which occurs when dyeing with the winch method, also called "thrashing". On the other side, dyeing is often uneven, probably as a result of dyeing being carried out industrially on fabrics of great height, and of it being generally impossible to maintain strictly uniform conditions throughout the dyeing device. Further, the dyeing processes currently employed in the art are expensive from the standpoint of energy consumption, because they are generally carried out at temperatures of up to 100° C. and above. Moreover, of course, also the dyeing of the aforesaid materials poses some problems which may be regarded as affecting the dyeing field in general, such as full exhaustion of the baths, the use of readily available dyes of relatively low cost, the achievement of desired color effects, and so forth.

A considerable advance in the specific field has been made with our copending Italian Patent Application No. 20782 A/80, wherein a dyeing method is disclosed which affords the possibility of operating at much lower temperatures than previously possible, e.g. of about 60° C. In carrying out the method, use is made of conventional acidic dye terns, the tern components being required to show—in accordance with what is universally regarded as necessary in the art—comparable characteristics of absorption and migration into the fiber, such that they can be combined with the fiber to a uniform degree to provide the desired final color, resulting from the combination of the elementary dye colors.

U.S. Pat. No. 3,980,428 discloses a dyeing process for polyamides, which in some cases may be carried out at a low temperature of down to 20° C. in the presence of a lactone which converts the solution pH from basic into acid (pH=5-6). While said patent specifies duration times of 3 to 48 hours for the dye fixing, actually a significant dyeing can only be obtained with the longest durations, and in all cases the process cannot be applied industrially owing to faults and irregularities in the resulting coloring, poor exhaustion of the dye, and so forth; and in actual practice, the Applicant is not aware of its having enjoyed industrial application.

SUMMARY OF THE INVENTION

The Applicant has now unexpectedly found that it is possible to effect staple dyeing of Nylon 6, particularly in the form of carpets and even more particularly with the winch dyeing method, at considerably lower temperatures than provided by our copending Application No. 20782 A/80 mentioned above, and particularly from room temperature (approximately 20° C.) to 40° C., with a process duration which does not exceed the norm in the art, but rather tending to be lower (e.g., 2 to 2.5 hours), to achieve perfectly uniform dyeing in industrial conditions, and accordingly through the use of those apparata and dyeing method conduction procedures which are commonplace in the art, by a method which is characterized by the following combined features:

(a) use of at least two discrete acidic dye combinations, which combinations have different kinetic dyeing characteristics in the sense which will be specified hereinafter;

(b) maintenance of an alkaline pH essentially throughout the dyeing method, but at tapering values, in the extreme, down to neutral, preferably from an initial range of 10 to 8.5 to a final range of 9.5 to 7;

(c) use of exclusively anionic dyeing aids;

(d) maximum temperatures up to 60° C., preferably up to 40° C.

The method of this invention affords the obtainment of dyed articles exhibiting a resistance to light and moisture which is quite the equal of those yielded by traditional dyeing methods.

Additional to the energy-wise advantages connected with the very low temperature at which the method is carried out, are qualitative advantages inherent to the appearance and "feel" of the articles (in particular with carpets, absence of "thrashing"), advantages connected with working safety in that the low temperature of the dyeing baths involves no scorching danger in the industrial practice, and advantages as regards to dye cost resulting from the shorter duration of the inventive method, which enables a better utilization of the equipment.

For a clearer understanding of the characteristics set forth above, the following should be held in mind.

Dyeing is normally effected with combinations of two or three, preferably three (tern) acidic dyes which may be regarded as characterized by their "color index" (briefly designated C.I.), which is a conventional index by which dyes are classed in fairly homogeneous groups, inter alia, under the aspect of their behaviors during the dyeing process. Said behavior is a function of several characteristics or behavioral components, and of less exactly assessed phenomena, such as the rapidity wherewith the color is absorbed by the fabric, the rapidity wherewith it migrates through the fabric, the rapidity wherewith it is fixed, and so forth. This set of characteristics determine, for a given fiber being treated, a typical behavior of each dye in the dyeing process, and a resultant balance in the distribution of the dye between the fabric and bath, whence there obviously derives a more or less complete utilization of the dye in the different dyeing conditions. The combination of said phenomena and behavioral components determine what may be generally defined as "the kinetic behavior" of the dye in the dyeing process.

These dyeing characteristics are described in the publication entitled "Some Observations on the Dyeing of Nylon with Mixtures of Acid Dyes", J.S.D.C. 74, by E. Atherton, D. A. Downey and R. H. Peters, pp. 242–251, and the "Technical Information" bulletin, published by Sandoz, Ltd., Basle, Switzerland, pp. 1–9.

The dye components which make up each of the dye combinations used must have a comparable kinetic behavior, if the colors they impart separately to the material to be dyed are to be in mutual balance and the desired color effect is to be achieved. As mentioned, for each C.I. there corresponds a defined kinetic behavior, thereby dyes of the same color and having the same C.I. may be regarded as mutually replaceable irrespective of their trade name and of their manufacturers, whereas dyes of different colors will generally have different C.I.'s even when they behave similarly kinetically. The C.I.'s of the various dyes are specified in a publication from S.D.C.-AATCC (Society of Dyers and Colorists—American Association of Textile Chemists and Colorists). In a general way, it is customary to say that the dyes are more or less "rapid", that is apt to provide, thanks to their kinetic behavior and all the other conditions being equal, a more or less rapid dyeing process of the fibers wherewith they can be conveniently used. The two dye combinations (preferably, the two terns), or possibly but not preferably, the pairs of dyes which are used in accordance with the first characteristic of this invention, may be regarded the one as "less rapid" and the other as "slow". Examples will be provided hereinafter on specific dye terns and pairs which constitute dye combinations suitable to implement the invention, while specifying the C.I.'s of the various base dyes which make them up. Of course, the invention is not limited by those dyes having such specific C.I.'s and trade names, since some variations in the dye "rapidity" are allowed in implementing this invention. It would be easy to arrange for laboratory tests directed to define the kinetic behavior of the various dyes, and accordingly, quantify the allowable variations in implementing the invention with respect to the exemplified terns; however, this is not necessary, because the skilled one can readily decide on whether a given dye lies sufficiently close, as far as the kinetic behavior is concerned, to the ones exemplified in the description which follows, such as to cause no excessive deviations in the preparation of the dye.

As for pH control, as mentioned, the latter should decrease during the dyeing process, while remaining alkaline or reaching—in the extreme—neutral state. An extremely convenient way of effecting this check, and one which is preferred in practicing this invention, is that of employing additives, comprising one or more preferably strong alkali to impart the initial alkaline pH, and one or more acid donors capable of generating acids at the method temperatures. Our prior patent application, as mentioned above, discloses additive pairs wherein the acid donor was a salt of a volatile base, in particular ammonium salt. Such salts become acid donors by decomposition and evaporation of ammonia at a temperature of 60° C., which is contemplated as the treatment final temperature, or at higher temperatures. Unexpectedly, it has been found that even at lower temperatures than 60° C. there seemingly occurs a sufficient dissociation of the ammonium salt to achieve the desired lowering of the pH, within the limits required for implementing this invention. However, owing to the low temperatures employed, and particularly where one is to operate at room temperature or one wishes to obtain particularly deep colors, it may be advantageous to add, preferably, toward the end of the dyeing process, a weak acid such as boric acid, or in particular, an organic acid such as acetic, citric, tartaric, maleic acid, and so forth. Particularly preferred temperatures according to the invention range from room temperature to 40° C.

DETAILED DESCRIPTION OF THE PREFERRED EMBODIMENT

In all cases, the initial pH of the dyeing bath is preferably in the 8.5 to 10 range, and decreases during the dyeing process, preferably down to 1.5 units while remaining, as mentioned, always above or in the extreme equal to 7. If the dyeing process is not carried out completely at room temperature, there occurs a first step of residence or imbibition at room temperature wherein the material to be dyed—in particular a carpet—is dipped into the dye-containing bath and bath containing an anionic aid and additives for pH control, for a few dozen minutes, e.g. 20 minutes, thereafter, during an intermediate step of a duration varying between 20 and 50 minutes, the temperature is raised to the final value, which may reach 40° C., and the dyeing cycle is completed in the course of a further residence step at said temperature for a time period generally in the 60 minutes to one and a half hour range, there being added where necessary, at one or more intervening moments of said dyeing step, a further amount of an acid donor or weak acid.

The duration of each step of the dyeing cycle is selected such that the overall cycle duration ranges from 110 to 160 minutes.

The anionic aids which may be conveniently used are of the equalizing type, such as the following: ATSA agent from Althouse, Univadine PS from Ciba-Geigy, and Sandogene CN from Sandoz (the trade names of the aids are registered trademarks by the listed Corporations).

Typical examples of dye terns which may be used for implementing this method are as follows:

Tern of medium-fast dyes:

C.I. acid orange—156

Nylosan-red-C-BNL-Sandoz (no C.I.)

C.I. acid blue—288

Tern of slow dyes:

C.I. acid yellow—219

C.I. acid red—57

C.I. acid blue—72

As mentioned above, this invention also provides for the use of two-dye combinations, although the three-dye (tern) combinations are the preferred ones. Examples of possible combinations of two dyes are as follows:

Combination of two medium-fast dyes:

C.I. acid orange—156

C.I. acid blue—288

Combination of two slow dyes:

C.I. acid yellow—219

C.I. acid blue—72

Non-limitative examples of dyes which constitute the dye combinations according to this invention would comprise: as the medium-fast C.I. yellow element, acid orange 156; Nylosan C-GNS orange from Sandoz; as medium-fast red element either Nylosan red C-BNL from Sandoz or C.I. acid red 392; as the medium-fast C.I. blue element, acid blue 288; Alizarine Light Blue BRP, Aquamine Blue BR, Nylosan Blue C-BRL, E-BRL and Sandolan Blue E-BRL from Sandoz or Erio-Blue BRL from Ciba-Geigy; as the slow C.I. yellow element acid yellow 219; Tectilon Yellow 4R from Ciba-Geigy, Nylosan Yellow C-RM from Sandoz, Erio Yellow 4R and Erionyl Yellow 4R from Ciba-Geigy, or in the alternative, yellow Nylanthrene B4RK from Althouse; as the slow C.I. red element, acid red 57; red Nailamide EP-ACNA, red Tectilon 3B from Ciba-Geigy, red Nylomine B-3B-ICI, red Novanyl L3GP - Yorkshire, red Nylosan C-BL from Sandoz, red Dimacide N-2BL-Ugine Kuhlmann; and as the slow C.I. blue element, acid blue 72; blue Acidol BE-BASF, blue Tectilon R from Ciba-Geigy, blue novanyl L-FG-Yorkshire, blue Nylosan C-GL from Sandoz, etc. (the trade names of the dyes are registered trademarks by the listed Corporations).

Where different dye combinations—whether terns or pairs—are to be used from the ones exemplified above, it should be appreciated not only that the overall kinetic characteristics of the combinations are required to be comparable but also that within each combination, the dye kinetic characteristics are to be uniform.

This may be easily determined by controlling the color of the dyeing material during the various steps of the dyeing process. If the kinetic characteristics of the components of each composition are uniform as they should be and the kinetic characteristics of the two combinations are in a proper desired ratio, then there will occur no color hue changes during the dyeing process but merely a deepening with time of the desired hue.

The desired uniformity will indicate the desired uniformity of absorption, migration, and fixing: which is in the dyeing parlance is generally designated as "hue mounting".

One of the basic advantages of this invention is the achievement in the aforesaid conditions, and hence with great energy savings, of a satisfactory and uniform color in practical industrial dyeing conditions. Of course, it would appear to be relatively easy to achieve good dyeing in controlled laboratory conditions, wherein all of the method variables are exactly and precisely determined and kept constant. But in the industrial practice this ideal situation never occurs. In particular, where carpets are dyed with the winch method, there occur, also on account of the considerable size of the device and material to be dyed, disuniformity of temperature, dye concentration, etc., due to the difficulty of achieving a sufficient rapidity of heat and mass transfer within the dyeing bath. Such disuniformity, which is always encountered, cannot be assessed a priori because they change between apparata, between places, and also according to the available equipment, process conduction, etc.

Consequently, the ascertainment that with a given plant a given method provides more or less satisfactory results or none, cannot give assurance of the same applying to other plants as well.

In order to better assess the characteristics and advantages of the method, and to enable adequacy of dye combinations, differently from the exemplified ones, which one may wish to adopt, it is convenient to adopt an experimental apparatus wherein deliberately produced are differences in temperature, dye concentration, and pH from one location to another which would on the average represent those irregularities which may be encountered in industrial practice.

Such an experimental setup allows simultaneous dyeing of two strips of the material to be dyed, taken from the batch which is to be subjected to dyeing on an industrial scale. The two strips, which have normally a length of about 2 m and width of about 0.5 m, are dyed in parallel by causing them to run over rollers which simulate dyeing with the method of the winch, through a bath contained in a tank wherein the areas where the two strips are repeatedly dipped are divided by a partition. The partition, depending on its configuration and position, allows a greater or lesser communicability of the bath between the two areas of the tank, thus enabling simulation of the various conditions which are encountered in industrial practice. In particular, it becomes possible to simulate between the two tank areas those differences in temperature, concentration and pH which are normally found in industrial processes between different locations in the dyeing bath or between repeated dyeing processes on one and the same initial product batch. These differences may be: 0.5° to 10.0° C. for temperature, and 0.1 to 2.0 units for pH.

In effecting such checking operation, it may be seen that the invention affords a very efficient dye application, from the standpoints of uniformity, quality of the resulting material, and color absorption, etc. (additionally to the cited and self-evident energy savings). It is surprising that this may be achieved through the use of dyes which belong to different combinations and which accordingly have different kinetic characteristics, and in the absence of any high temperature steps, which—as is known—tends to make the dye application uniform and to remove mounting irregularities. In fact, with traditional dyeing methods, if one checks the material during the various process steps, one finds that the color hue changes appreciably in the transition from the low temperature step to the final high temperature step. In the present case this does not occur, and this is a condition for the efficiency of the method, which eliminates the high temperature step.

EXAMPLE 1

This example illustrates dyeing with the full width Brueckner method of the winch of a tufted velour carpet comprising 100% Nylon 6 polyamide staple from SNIA FIBRE S.p.A. having the following composition: 100% 6-6.7 dtex Nylon staple with three-lobe cross-section, glossy and antistatic, weight of the carpet (plush only) 580 g/m$^2$.

The required bath volume is prepared by using purified water at room temperature (20° C.), and the pumps which cause bath circulation are operated. Then, 0.2 ml/l caustic soda 36° Be and 0.5% Sandogene CN-Sandoz as anionic aid are added directly into the filters. Subsequently, the dyes are added quickly, followed by 0.8 g/l ammonium sulphate, dissolved separately in specially provided vessels.

The Rotten Green color of this example is obtained with the following dyes:

(a) slow tern :
- 0.3% C.I. acid yellow 219
- 0.119% C.I. acid red 57
- 0.34% C.I. acid blue 72

(b) medium-fast tern:
- 0.15% C.I. acid orange 156
- 0.051% Nylosan red C-BNL-Sandoz
- 0.34% C.I. acid blue 288

After tha last addition, the bath is circulated for an additional 5 minutes.

pH checking indicates an initial value of pH=9. The carpet to be dyed is quickly introduced into the bath and its two ends are sewn. Then, the carpet is caused to run through the bath at a temperatuare of 20° C. for 20 minutes. Later, the bath is gradually heated over 20 minutes from 20° C. to 40° C. (temperature gradient 1° C./min). After a residence time of 30 minutes of the carpet in the dyeing bath at 40° C., 0.8 g/l more of ammonium sulphate dissolved in abundant water are slowly added. The addition of ammonium sulphate is defined slow in that it takes place over a time period of 10 minutes.

The dyeing cycle is terminated with an additional residence of the carpet in the bath at 40° C. for a time period of 60 minutes counted from the moment the ammonium sulphate begins to be added.

The final pH is 7.9 and the total time required is 2 hours and 10 minutes. Then, the bath is discharged and the dyed carpet washed as normal.

EXAMPLE 2

The same dyeing material, color, and recipe (same compounds in the same amounts) are used, and the same dyeing method as in Example 1 is employed, only the dyeing cycle being changed as follows:

initial pH=9
final pH=8.2
- initial temperature 18° C. (room temperature)
- residence time 70 min at room temperature (the temperature has spontaneously increased to 24° C.)
- slow addition (over about 10 min) of the second part of ammonium sulphate with
- further 90 min residence at room temperature, including the time for adding the ammonium sulphate
- end of dyeing (total time 2 hours 40 minutes)
- washing

EXAMPLE 3

Full width dyeing on Brueckner winch of a tufted velour carpet comprising 100% Nylon 6 polyamide staple from SNIA FIBRE S.p.A. having the following composition:

70% Nylon 6 staple, 9.4 dtex three-lobe semiglossy
30% Nylon 6 staple, 13 dtex three-lobe semiglossy carpet weight (plush only) 550 g/m$^2$.

Color Pale Grey (a) slow tern :
- 0.023% C.I. acid yellow 219
- 0.0375% C.I. acid red 57
- 0.0637% C.I. acid blue 72

(b) medium-fast tern :
- 0.0115% C.I. acid orange 156
- 0.016% Nylosan red C-BNL-Sandoz
- 0.0637% C.I. acid blue 288

1% Agent Atsa B—Althouse
0.2 g/l ammonium sulphate (1st part)
0.5 cc/l 36° Be caustic soda
0.2 g/l ammonium sulphate (2nd part)
initial pH=9.9
final pH=8.4

Dying cycle

- initial temperature 20° C.
- residence time 20 min at 20° C.
- heating over 20 min to 40° C. (thermal gradient 1° C./min)
- after 30 min at 40° C., slow addition (over about 10 min) of the second part of ammonium sulphate
- further residence for 60 min at 40° C., including the time for adding the ammonium sulphate
- end of the dyeing process (total time 2 hours 10 minutes)
- washing

EXAMPLE 4

Same material, same color, and same recipe as in Example 3.

initial pH=10
final pH=8.6

Dyeing cycle

- initial temperature 20° C. (room temperature)
- residence time 70 minutes at room temperature (the temperature has spontaneously increased to 23° C.)
- slow addition (over about 10 minutes) of the second part of ammonium sulphate
- further residence for 90 minutes at room temperature including the time for adding the ammonium sulphate
- end of the dyeing process (total time 2 hours 40 minutes)
- washing

EXAMPLE 5

Full width dyeing on Brueckner winch of a tufted velour carpet comprising 100% Nylon 6 polyamide antistatic staple from SNIA FIBRE S.p.A. and having the following composition:

100% Nylon 6 staple 6.7 dtex three-lobe glossy weight of carpet (plush only) 580 g/m$^2$ color Deep Brown (a) slow tern : 0.259% C.I. acid yellow 219
0.245% C.I. acid red 57
0.265% C.I. acid blue 72
(b) medium-fast tern : 0.111% C.I. acid orange 156
0.105% Nylosan red C-BNL-Sandoz
0.265% C.I. acid blue 288
0.5% Agent Atsa B—Althouse
0.8 g/l ammonium sulphate (1st part)
0.2 cc/l caustic soda 36° Be
0.8 g/l ammonium sulphate (2nd part)
initial pH=9.5 final pH=8.3

Dyeing cycle initial temperature 20° C. (room temperature)
residence time 20 min at 20° C.
heating over 20 min at 40° C. (thermal gradient 1° C./min)
after 30 minutes at 40° C., slow addition (over about 10 minutes) of the second part of ammonium sulphate
further residence for 60 minutes at 40° C. including the ammonium sulphate addition time
end of the dyeing process (total time 2 hours 10 minutes)
washing

EXAMPLE 6

Full width dyeing on a Brueckner winch of a carpet having the same composition as Example 5.

Color Beige (a) slow tern :
0.050% C.I. acid yellow 219
0.406% C.I. acid red 57
0.036% C.I. acid blue 72
(b) medium-fast tern : 0.21% C.I. acid orange 156
0.017% Nylosan red C-BNL-Sandoz
0.036% C.I. acid blue 288
1% Agent Atsa B—Althouse
0.5 g/l ammonium sulphate
0.3 cc/l caustic soda 36° Be
0.5 g/l ammonium sulphate
initial pH=9.5
final pH=8.3
Dyeing cycle
initial temperature 20° C. (room temperature)
residence time 20 min at 20° C.
heating to 40° C. in 20 min (thermal gradient 1° C./min)
after 30 min at 40° C., slow addition (over about 10 min) of the second part of ammonium sulphate (dissolved in abundant water)
further residence for 60 min at 40° C. including the time for adding the ammonium sulphate
end of the dyeing process (total time 2 hours 10 minutes)
washing

EXAMPLE 7

Full width dyeing on a Brueckner winch of a tufted velour carpet comprising 100% Nylon 6 polyamide antistatic staple from SNIA FIBRE S.p.A. and having the following composition:

42% Nylon 6 staple 6.7 dtex matt circular
45% Nylon 6 staple 13 dtex semiglossy circular
20% Nylon 6 staple 20 dtex matt circular carpet weight (plush only) 900 g/m$^2$ Color Cream White (a) slow tern:
0.021% C.I. acid yellow 219
0.0065% C.I. acid red 57
0.0057% C.I. acid blue 72
(b) medium-fast tern : 0.009% C.I. acid orange 156
0.0027% Nylosan red C-BNL-Sandoz
0.0057% C.I. acid blue 288
1% Agent Atsa B—Althouse
0.2 g/l ammonium sulphate
0.5 cc/l caustic soda 36° Be
0.2 g/l ammonium sulphate
initial pH=10
final pH=8.9
Dyeing cycle
initial temperature 20° C. (room temperature)
residence time 70 min at room temperature (the temperature raises spontaneously to 24° C.)
slow addition (over about 10 min) of the second part of ammonium sulphate (dissolved in abundant water)
further residence for 90 min at room temperature, including the time for adding the ammonium sulphate
end of the dyeing process (total time 2 hours 40 minutes)
washing

EXAMPLE 8

Full width dyeing on a Brueckner winch of a carpet having the same composition as Example 7.

Color Greysh Blue (a) slow tern:
0.081 C.I. acid yellow 219
0.059 C.I. acid red 57
0.28 C.I. acid blue 72
(b) medium-fast tern:
0.034 C.I. acid orange 156
0.025 Nylosan red C-BNL-Sandoz
0.28 C.I. acid blue 288
0.8% Sandogene CN-Sandoz
0.5 g/l ammonium sulphate
0.3 cc/l caustic soda 36° e
0.5 g/l ammonium sulphate
initial pH=9.5 final pH=8.4

Dyeing cycle initial temperature 20° C. (room temperature)
residence time 20 min at 20° C.
heating over 20 min to 40° C. (thermal gradient 1° C./min)
after 30 min at 40° C., slow addition (over about 10 min) of the second part of ammonium sulphate (dissolved in abundant water)
further residence for 60 min at 40° C. including the time required to add the ammonium sulphate
end of the dyeing process (total time 2 hours 10 minutes)
washing

EXAMPLE 9

Full width dyeing on a Brueckner winch of a carpet having the same composition as Example 1.

Color Dark Beige (a) slow tern:
0.175 C.I. acid yellow 219
0.098 C.I. acid red 57
0.085 C.I. acid blue 72
(b) medium-fast tern:
0.075 C.I. acid orange 156
0.042 Nylosan red C-BNL-Sandoz
0.085 C.I. acid blue 288
0.8% Agent Atsa B—Althouse
0.5 g/l ammonium sulphate
0.3 cc/l caustic soda 36° e
0.5 g/l ammonium sulphate
initial pH=9.5
final pH=8.4

Dyeing cycle initial temperature 18° C. (room temperature)
residence time 20 min at room temperature
heating over 22 min to 40° C. (thermal gradient 1° C./min)
after 30 min at 40° C., slow addition (over about 10 min) of the second part of ammonium sulphate (dissolved in abundant water)
further residence for 60 min at 40° C. including the time for adding the ammonium sulphate
end of the dyeing process (total time 2 hours 12 minutes)
washing

EXAMPLE 10

Full width dyeing on a Brueckner winch of a carpet having the same composition as Example 1 and dyed to the same Dark Beige color as in Example 9.

Color Dark Beige (a) slow tern:
0.175 % C.I. acid yellow 219
0.098 % C.I. acid red 57
0.085 % C.I. acid blue 72
(b) medium-fast tern:
0.075 % C.I. acid orange 156
0.042 % Nylosan red C-BNL-Sandoz
0.085 % C.I. acid blue 288
0.8 % Agent Atsa B—Althouse
0.5 g/l ammonium sulphate
0.3 cc/l saustic soda 36° e
0.1 cc/l acetic acid 90%
initial pH=9.5 final pH=8

Dyeing cycle initial temperature 18° C. (room temperature)
residence time 70 min at room temperature
slow addition (over about 20 min) of the indicated amount of suitably diluted acetic acid
further residence for 90 min at room temperature (including the time required for the addition of the acetic acid)
end of the dyeing process (total time 2 hours 40 minutes)
washing

EXAMPLE 11

Full width dyeing on a Brueckner winch of a tufted velour carpet comprising 100% antistatic 20 dtex semi-glossy profiled Nylon 6 polyamide staple from SNIA FIBRE S.p.A.; carpet weight (plush only) 550 g/m$^2$.

Color Blue (a) slow combination:
0.06 % C.I. acid yellow 219
0.78 % C.I. acid blue 72
(b) medium-fast combination:
0.03% C.I. acid orange 156
0.78% C.I. acid blue 288
0.5% Agent Atsa B—Althouse
0.8 g/l ammonium sulphate
0.2 cc/l caustic soda 36° e
1.2 g/l ammonium sulphate
initial pH=9
final pH=7.5

Dyeing cycle initial temperature 19° C.
residence time 20 min at 19° C.
heating over 21 min to 40° C. (thermal gradient 1° C./min)
after 30 min at 40° C., slow addition (over about 15 min) of the second part of the ammonium sulphate
further residence for 60 min at 40° C. including the the time required to add the ammonium sulphate
end of the dyeing process (total time 2 hours 11 min)
washing

EXAMPLE 12

Full width dyeing on a Brueckner winch of tufted velour carpet having the same composition as Example 11.

Color Green (a) slow combination : 0.5% C.I. acid yellow 219
0.28% C.I. acid blue 72
(b) medium-fast combination: 0.25% C.I. acid orange 156
0.28% C.I. acid blue 288
0.5% Agent Atsa B—Althouse
0.8 g/l ammonium sulphate
0.2 cc/l caustic soda 36° e
1.2 g/l ammonium sulphate
initial pH=9
final pH=7.5

Dyeing cycle initial temperature 20° C.
residence time 20 min at 20° C.
heating over 20 min to 40° C. (thermal gradient 1° C./min)
after 30 min at 40° C., slow addition (over about 10 min) of the second part of the ammonium sulphate (as dissolved in abundant water)
further residence for 60 min at 40° C. including the time required to add the ammonium sulphate
end of the dyeing process (total time 2 hours 10 min)
washing

EXAMPLE 13

Full width dyeing on a Brueckner winch of a tufted velour carpet having the same composition as Example 11.

Color Crimson (a) slow combination:
0.6% C.I. acid yellow 219
0.826% C.I. acid red 57
0.125% C.I. acid blue 72

(b) medium-fast combination:
0.3% C.I. acid orange 156
0.354% Nylosan red C-BNL-Sandoz
0.126% C.I. acid blue 288
0.5% Sandogene CN-Sandoz
0.8 g/l ammonium sulphate
0.2 cc/l caustic soda 36° e ammonium sulphate
initial pH=9
pH=7.6

Dyeing cycle initial temperature 20° C.
residence time 20 min at 20° C.
heating over 20 min to 40° C. (thermal gradient 1° C./min)
after 30 min at 40° C., slow addition (over about 10 min) of the second part of ammonium sulphate (as dissolved in abundant water)
after further 30 min, slow addition (over about 10 min) of the third and last part of ammonium sulphate
further residence for 60 min at 40° C.
end of the dyeing process (total time 2 hours 40 minutes)
washing

We claim:

1. In a method for dyeing textile materials comprising polycapronamide or Nylon 6, which comprises contacting said textile materials with a dye bath to dye the textile, and removing the thus-dyed textile material therefrom, the improvement in which the dye bath comprises two different combinations of acidic dyes, each combination being composed of two or more acidic dyes making up the combination and each dye of the acidic dyes of the combination having substantially the same rate of absorption onto the polycapronamide or Nylon 6 textile fiber, a combination having a substantially different rate of absorption onto the textile fiber with respect to the other combination, such that the rate of absorption of one combination is substantially slower than the other; said bath also containing only anionic dyeing assistants and is maintained at an alkaline pH, essentially during the entire dyeing operation, initially at a pH in the range of 8.5–10 and decreasing by about 1.5 pH units in the last dyeing stage, the dyeing bath being maintained at a temperature of from about 20° C. to 40° C.

* * * * *